US008516846B2

(12) United States Patent
Lee et al.

(10) Patent No.: US 8,516,846 B2
(45) Date of Patent: Aug. 27, 2013

(54) ICE MAKER AND REFRIGERATOR HAVING THE SAME

(75) Inventors: Tae-Hee Lee, Seoul (KR); Hong-Hee Park, Seoul (KR); Joon-Hwan Oh, Seoul (KR); Young-Jin Kim, Seoul (KR); Kwang-Ha Suh, Seoul (KR); Jin-Sung Park, Seoul (KR)

(73) Assignee: LG Electronics Inc., Seoul (KR)

( * ) Notice: Subject to any disclaimer, the term of this patent is extended or adjusted under 35 U.S.C. 154(b) by 1071 days.

(21) Appl. No.: 12/062,827

(22) Filed: Apr. 4, 2008

(65) Prior Publication Data

US 2009/0049858 A1 Feb. 26, 2009

(30) Foreign Application Priority Data

Aug. 20, 2007 (KR) ..... 10-2007-0083646

(51) Int. Cl.
*F25C 5/08* (2006.01)
*F25C 1/00* (2006.01)
*F25C 1/04* (2006.01)

(52) U.S. Cl.
USPC ..... 62/349; 62/353; 62/356

(58) Field of Classification Search
USPC ..... 62/349, 350, 353, 352, 351, 344
See application file for complete search history.

(56) References Cited

U.S. PATENT DOCUMENTS

| | | | | |
|---|---|---|---|---|
| 3,783,636 | A * | 1/1974 | Archer | 62/353 |
| 4,450,692 | A * | 5/1984 | Sharpe et al. | 62/233 |
| 5,187,948 | A * | 2/1993 | Frohbieter | 62/351 |
| 2005/0115266 | A1* | 6/2005 | Lim et al. | 62/351 |

FOREIGN PATENT DOCUMENTS

| | | |
|---|---|---|
| KR | 10-1996-0018443 | 6/1996 |
| KR | 10-2004-003909 A | 5/2004 |
| KR | 10-2004-0039089 A | 5/2004 |
| KR | 10-2006-0060449 A | 6/2006 |

OTHER PUBLICATIONS

International PCT Search Report and Written Opinion dated Nov. 13, 2008.

* cited by examiner

*Primary Examiner* — Frantz Jules
*Assistant Examiner* — Cassey D Bauer
(74) *Attorney, Agent, or Firm* — KED & Associates LLP

(57) ABSTRACT

An ice maker and a refrigerator having the same include an ice making container which is maintained at a temperature higher than a freezing point of water. Ace core rods having the temperature lower than the freezing point are inserted into the ice making container to cause water in the container to freeze. Accordingly, water at the periphery of the ice making container remains liquid which the water surrounding the ice core rods freezes. As a result, air bubbles generated when the ice is made can be discharged from the liquid portions of the water at the outer edges of the container. This results in ice without trapped air bubbles, which allows excellent transparent ice pieces to be formed. In some embodiments, the exterior surfaces of the ice making container are maintained at a temperature lower than the freezing point of water, and thawing rods maintained at the temperature higher than the freezing point of water are inserted into the center portions of the ice making container. In this embodiment, water at the edges of the ice making container are frozen first, while the water surrounding the thawing rods remains liquid. This also allows air bubbles to escape during formation of the ice, which results in transparent ice pieces.

35 Claims, 7 Drawing Sheets

ICE MAKER AND REFRIGERATOR HAVING THE SAME

The present application claims priority to Korean Application No. 10-2007-0083646, filed in Korea on Aug. 20, 2007, which is herein expressly incorporated by reference in its entirety.

BACKGROUND

1. Field

The present application discloses an ice maker and a refrigerator having the same.

2. Background

Currently available large-sized refrigerators have ice makers which are capable of making a certain shape of ice pieces. In such ice makers, cool air is supplied to a certain amount of water having been supplied to an ice making container. Once the water has been converted into ice, the ice pieces in the ice making container are transferred to an ice storage container by an ice separating apparatus so as to be stored therein.

In such ice makers, the ice making container is installed in a location within the refrigerator where the temperature is maintained at or below 0° C., which is the freezing point of water (hereafter, abbreviated as the freezing point). The water in the container is frozen by cool air. The water is usually first frozen from at an area that is directly in contact with the cool air supplied into the ice maker. The ice formation then progresses toward a central area of the ice container More specifically, the water in the container is first cooled by coming in contact with the peripheral cool air, which usually means at an inner circumferential surface of the ice making container. The water then continues to be frozen toward the center of the ice making container In most existing ice makers, the water supplied to the ice making container contains a certain amount of air. Some of the air is separated from the water while the water in the ice making container is frozen. However, some of the air is trapped in the ice in the form of bubbles in the ice. Ideally, one would like all of the air to be removed from the water before it turns to ice so that no bubbles are formed in the ice. But during the ice making procedure in existing ice makers, the water surface is first frozen, as discussed above, and accordingly all of the air in the water cannot be removed. This is the reason that air bubbles remain trapped in the ice, and this is why the ice is formed as opaque ice pieces.

BRIEF DESCRIPTION OF THE DRAWINGS

The embodiments will be described in detail with reference to the following drawings, in which like reference numerals refer to like elements, and wherein.

DETAILED DESCRIPTION

Figure 1:
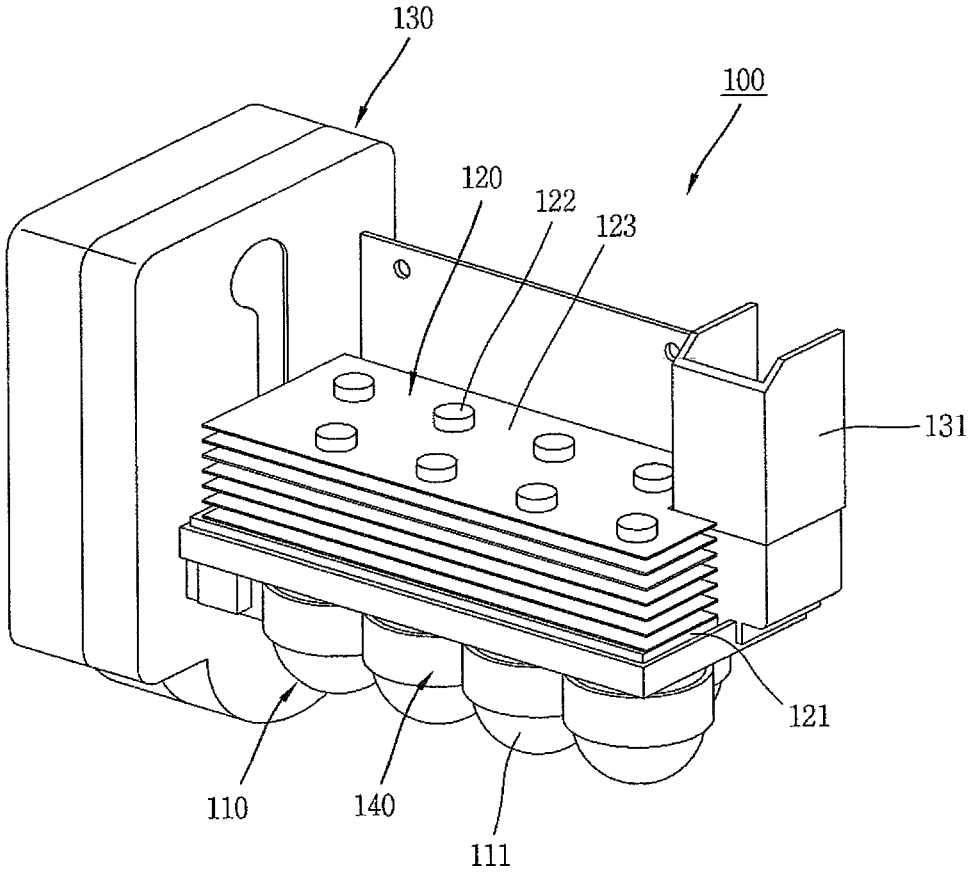
FIG. 1 is a perspective view showing a first embodiment of an ice maker.

As shown in FIG. 1, a first embodiment of an ice maker 100 includes an ice making container 110 having an exterior surface that can be maintained at a temperature higher than the freezing point of water. At least one ice core unit 120 partially extends into the water of the ice making container 110 so as to cool the water to below the freezing point. A transfer unit 130 moves the ice making unit 120 and/or the ice making container upward and downward, and also rotating the same so as to transfer ice pieces into an ice storage container (not shown).

The ice making container 110 is provided with at least one ice making space 111 for receiving water supplied from a water supply apparatus (not shown). The ice making container is, configured to have a temperature of a peripheral portion lower than the freezing point so that the water in the ice making space 111 can be frozen.

Figure 2:
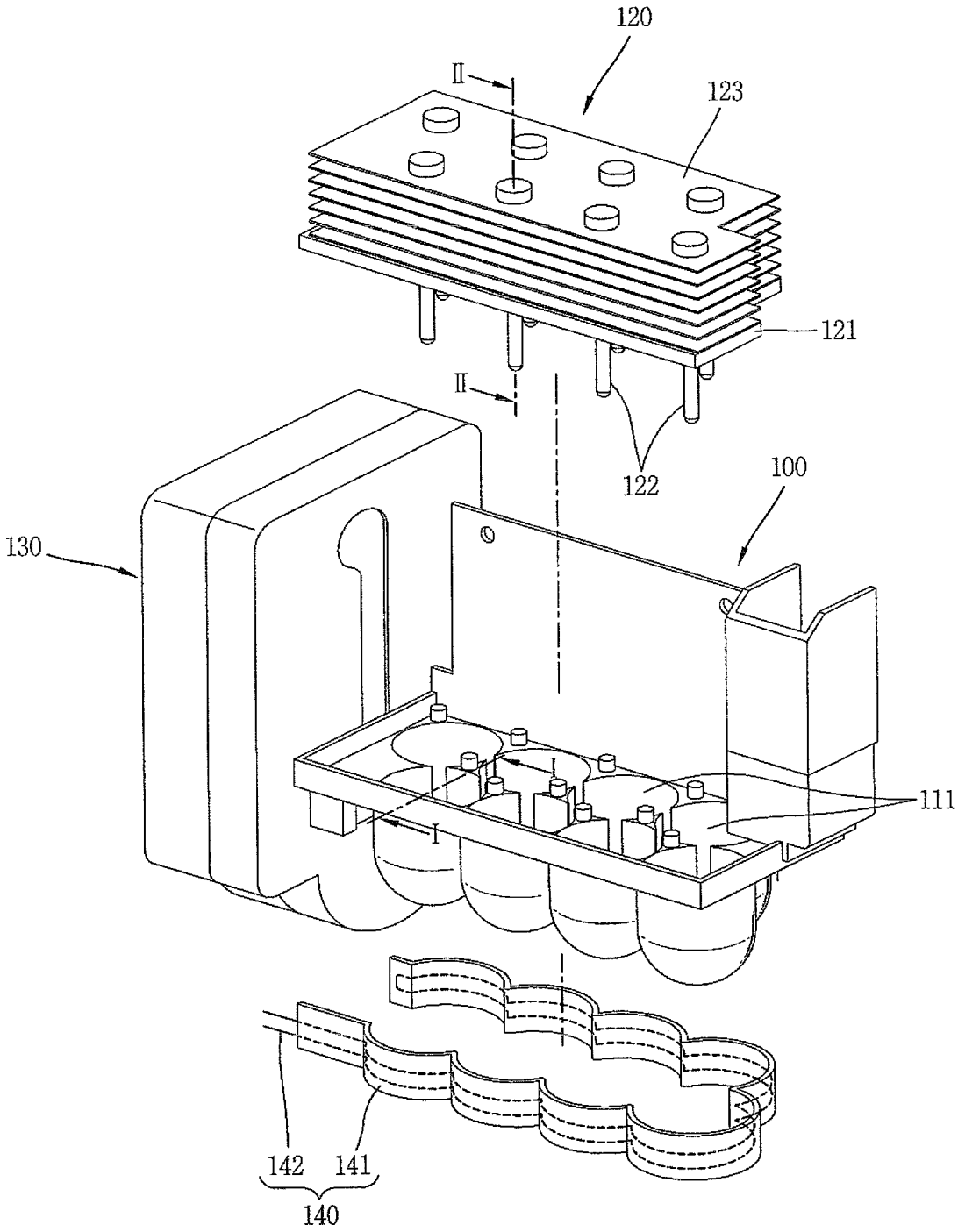
FIG. 2 is an exploded perspective view showing the ice maker in FIG. 1.
Figure 3:
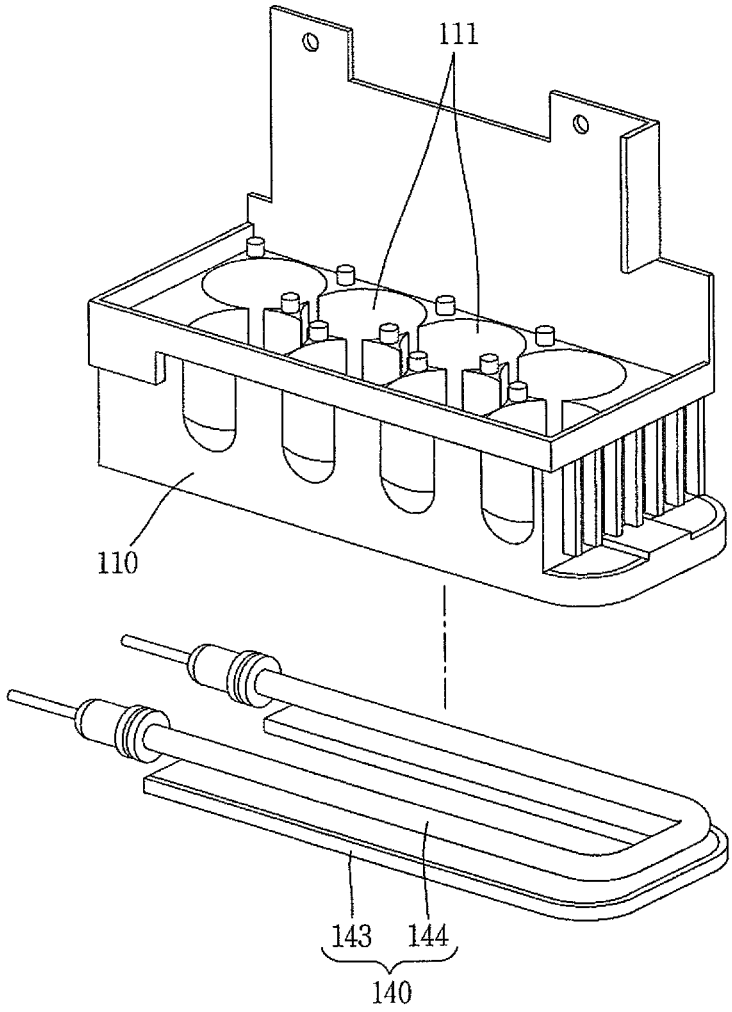
FIG. 3 is a perspective view showing an alternate embodiment of an ice maker.
Figure 4:
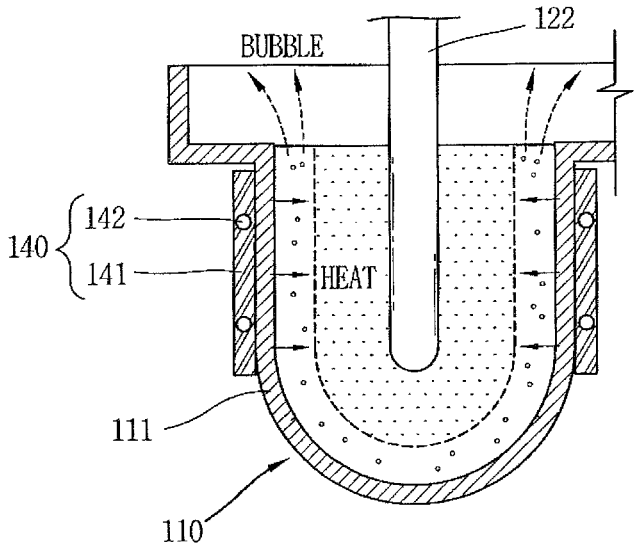
FIG. 4 is a cross-sectional view taken along Section line I-I in FIG. 2.

The ice making container 110 is also provided with a heater 140 that can heat a surface of the ice making container 110 or an inside thereof above the freezing point so as to maintain an inner circumferential surface of the ice making space 111 at the temperature higher than the freezing point. The heater 140 may be implemented as a plate type heater, as shown in FIGS. 2 and 4, or as a rod type heater which is "U" shaped, as shown in FIG. 3. The "U" shaped rod type heater would surround the ice making container 110.

In the case of the plate type heater, an electrical heating coil 142 could be installed in a plate-shaped body 141 which is adhered to an outer circumferential surface of the ice making container 110. In the case of the rod type heater, a heater rod 144 is mounted at an inner side of a heater cover 143 that is coupled to a bottom of the ice making container 110.

Figure 5:
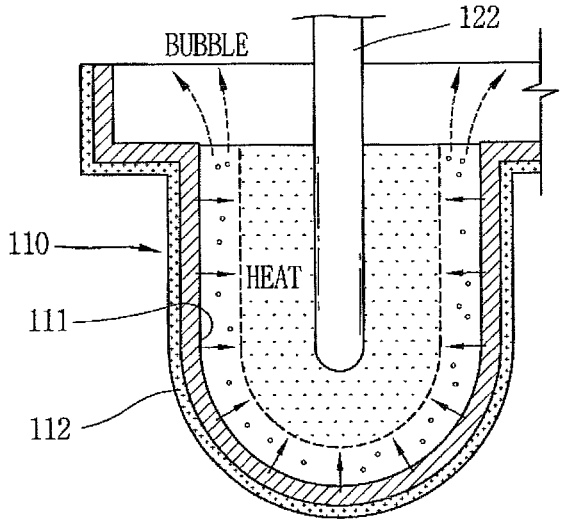
FIG. 5 is a cross-sectional view showing an alternate embodiment of the device shown in FIG. 4.

Further, as shown in FIG. 5, the ice making container 110 may have a heat insulator 112 attached onto the outer circumferential surface of the ice making container 110, or an inner circumferential surface thereof. Alternately, even though it is not shown in the drawing, the ice making container 110 itself may be formed of an insulating material or a material in which the insulating material is mixed. In this case, if room temperature water is supplied to the ice making container 110, the heat of the water would not be outwardly discharged due to the heat insulator (or the insulating material). Accordingly the periphery of the inner circumferential surface of the ice making container 110 may be maintained at the temperature higher than the freezing temperature. This also prevents the heat of the water from heating other adjacent objects within a freezer space of the refrigerator.

Even though it is not shown in the drawing, the ice making container may be provided with only one ice making space, plus a plurality of ice core rods. Alternatively, a plurality of ice making spaces may be formed in the ice making container.

As shown in FIG. 2, the ice core unit 120 is implemented as a horizontal plate body, including an ice core body 121 having one lateral surface coupled to the transfer unit 130. A plurality of ice core rods 122 are inserted into the ice core body 121 in a vertical direction. and a plurality of heat radiating fins 123 are laminated to each other and are attached to upper end portions of the ice core rods 122.

Figure 6:
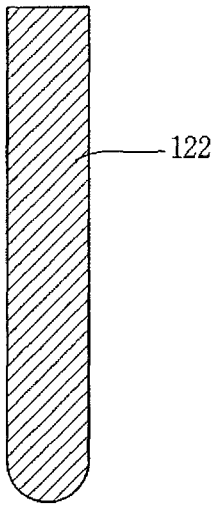
FIGS. 6 to 8 are cross-sectional views taken along Section line II-II in FIG. 2, showing embodiments of ice core rods.

As shown in FIG. 6, the ice core rods 122 may be formed of a single material, for example, a metal such as aluminium, copper or the like which has excellent thermal conductivity.

Figure 7:
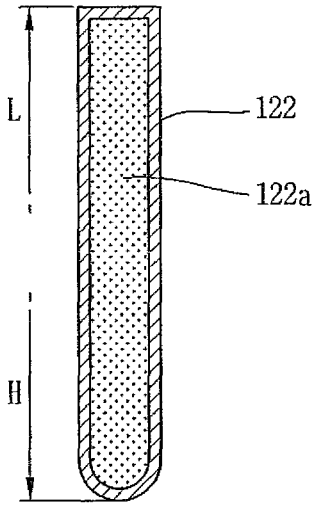

The ice core rods 122 may also be formed of a nonmetallic material such as carbon nano tubes, etc. Further, as shown in FIG. 7, the ice core rods 122 may be comprised of a heat pipe provided with a heat pump passage 122*a* that contains an operation fluid therein.

Because the water in the ice making container 110 is first at room temperature, while the temperature in the surrounding freezing chamber is below the freezing point, typically approximately −18° C., each ice core rod 122 may have a higher temperature portion H which is immersed in the water of the ice making container 110, and a lower temperature portion L which is exposed to the freezing chamber of the refrigerator.

Figure 8:
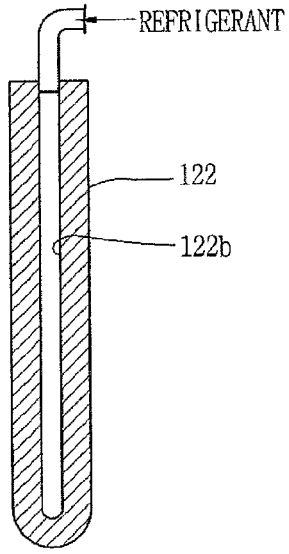

Further, as shown in FIG. 8, the ice core rods 122 may be provided with a refrigerant passage 122*b* therein. Here, a fan or an air pump may be installed in the middle of the refrigerant passage 122*b* of the ice core rods 122 so as to supply a refrigerant by being connected to a refrigerating cycle circulating the refrigerant into the freezing chamber to a cooling chamber of the refrigerator, or so as to supply cool air in the freezing chamber.

Further, even though it is not shown in the drawing, the ice core rods 122 may have one side onto which a thermoelectric module is attached so as to perform a cooling operation by using a potential difference.

As shown in FIG. 2, the plurality of heat radiating fins 123 may be laminated to each other at a portion where the ice core rods 122 are not immersed in the water of the ice making container 110, i.e., where the ice core rods 122 are exposed to the freezing chamber of the refrigerator.

The transfer unit 130 may be provided with one or more driving motors or electric members properly arranged so as to move the ice core unit 120 upwardly and downwardly, and so as to rotate the same at the same time. Preferably, a heat emitting body (not shown) for separating ice pieces by applying heat to the surface of the ice core rods 122 may be connected to one side of the ice core rods 122 so that the ice pieces can be automatically disposed in an ice storage container after the ice has been formed.

A transferring guide 131 for guiding movements of the various parts may also be included in the ice maker.

An ice making procedure will be described with reference to the drawing figures.

After water has been supplied to the ice making space 111 of the ice making container 110 by a water supply apparatus (not shown), an electric current is applied to the heater 140 adjacent to the ice making container 110 so that an exterior surface of the ice making container 110 is maintained at a temperature higher than the freezing point. The upper ends of each ice making rod 122, i.e., the portion that is not immersed in the ice making space 111, is maintained at a temperature lower than the freezing point by the heat radiating fins 123. In some embodiments, an operation fluid within the ice making rods, or a refrigerant flowing through the rods, or a cool temperature generated by electrical means will be used to help keep the upper ends of the rods below the freezing point.

When the ice making container 110 is formed of an insulating material, or a heat insulator 112 is attached onto the outer circumferential surface thereof, the temperature of the water in contact with the peripheral surfaces of the ice making container will be maintained at a temperature higher than the freezing point without the need to supply additional heat to the ice making container 110. However, so as to actively cope with changes of external conditions that can be generated in practical use, a heater 140 or the like may be provided to apply heat to the external surfaces of the ice making container 110 as needed.

As a result of this configuration ice begins to form at the center of the ice making container, where the ice core rods 122 are immersed in the water of the ice making container 110. Water at the periphery of the ice making container 110 is not initially frozen into ice because it is being maintained at a temperature higher than the freezing point.

Because the external surfaces of the water are not frozen, air within the water is allowed to separate out from the water as the water freezes. Because air bubbles are discharged out of the water during the freezing process no air bubbles are frozen into ice. As a result, the ice maker can create excellent transparent ice pieces.

In some embodiments, the ice making container 110 may be implemented as an electrically conductive body formed of a material that allows the ice making container 110 to generate heat by itself, thereby maintaining the peripheral surfaces of the water at a temperature higher than the freezing point by the application of an electric current applied to electrodes connected to both ends thereof. A thermally and electrically conductive composite material such as E5101 manufactured by the CoolPolymers. Inc., or an electrically conductive composite material such a LUCON based material manufactured by the LG Chem, Ltd. may be used for this purpose.

In aforementioned embodiments, the ice core rods maintained at the temperature lower than the freezing point are inserted into the water of the ice making container while the ice making container is maintained at the temperature higher than the freezing point. But, in alternate embodiments, the thawing rods maintained at the temperature higher than the freezing point can be inserted into the water of the ice making container while the ice making container itself is maintained at the temperature lower than the freezing point.

Figure 9:
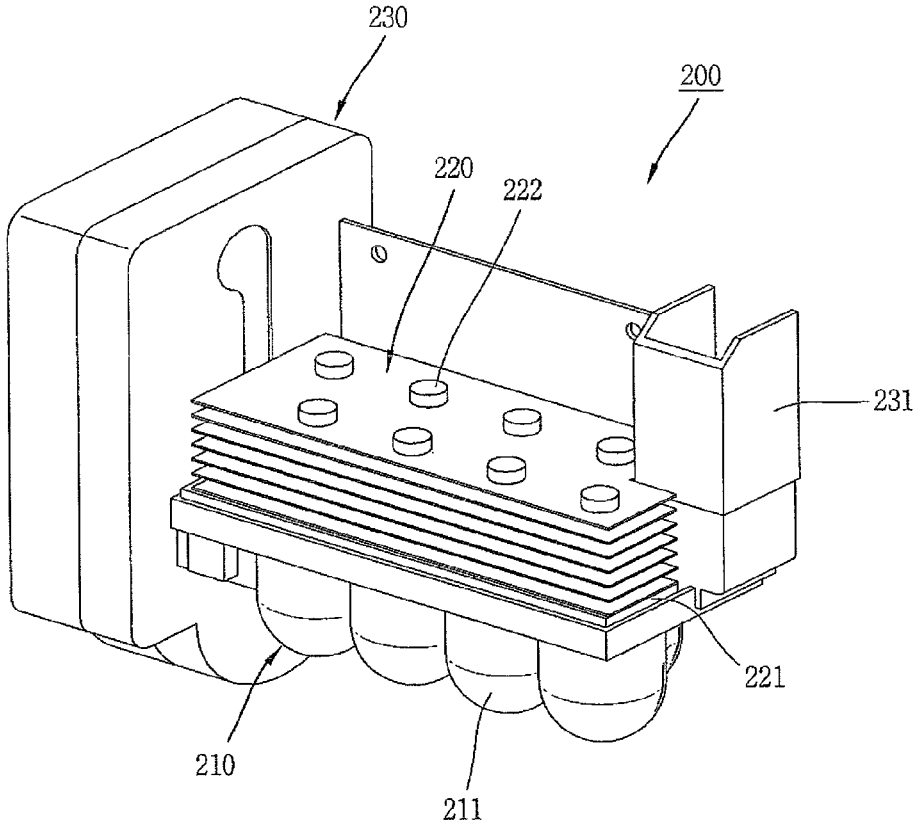
FIG. 9 is a perspective view showing another embodiment of an ice maker.

For example, as shown in FIG. 9, an ice maker 200 in accordance with this embodiment includes an ice making container 210 having a surface that is maintained at the temperature lower than the freezing point, and which is provided with a plurality of ice making spaces 211. At least one thawing unit 220 is partially immersed in the water of the ice making container 210. so as to transfer heat into the water. A transfer unit 230 upwardly/downwardly moves the ice making unit 120 or rotates the same so as to transfer ice into an ice storage container (not shown).

The ice making container 210 may be formed of a metal having an excellent thermal conductivity, or a nonmetallic material, or a plastic or synthetic material.

The thawing unit 220 includes a thawing body 221 having one lateral surface coupled to the transfer unit 230. A plurality of thawing rods 222 are inserted into the thawing body 221 so as to maintain the water in the center portion of the ice container at a temperature above freezing. The thawing rods 222 are preferably formed of a material having an excellent thermal conductivity. A heater (not shown) generates heat and may be installed at the surface or the inside thereof.

The transfer unit 230 may be provided with the plurality of driving motors or electric members properly arranged, which allows the thawing unit 220 to be moved upwardly/downwardly, and at the same time, to rotate.

Figure 10:
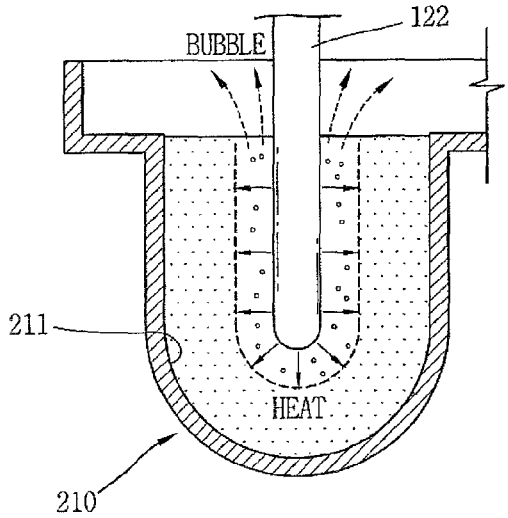
FIG. 10 is a cross-sectional view showing a portion of the ice maker in FIG. 9.

A procedure for making ice using this alternate embodiment is essentially the same as for the previous embodiments, and will therefore be omitted. But, in this embodiment, as shown in FIG. 10, as the inner circumferential surface of the ice making container 210 is maintained at the temperature lower than the freezing point, the water will first freeze into ice from the inner circumferential surface of the ice making container 210, while the water surrounding the periphery of each thawing rod 222 remains in a liquid state. Accordingly, air bubbles generated when the water starts to freeze will be discharged out of the liquid water located around the periphery of each thawing rod 222. Thus, this embodiment is also capable of making excellent transparent ice pieces.

The ice core rods 122 or the thawing rods 222 are rotatably installed, and are therefore capable of serving as an ejector for transfer the ice made in the ice making containers 110, 210. In this case, the ice making containers 110, 210 should be provided with some form of heater for separating the frozen ice therefrom, so as to facilitatingly perform the separating operation of the ice pieces.

Figure 11:
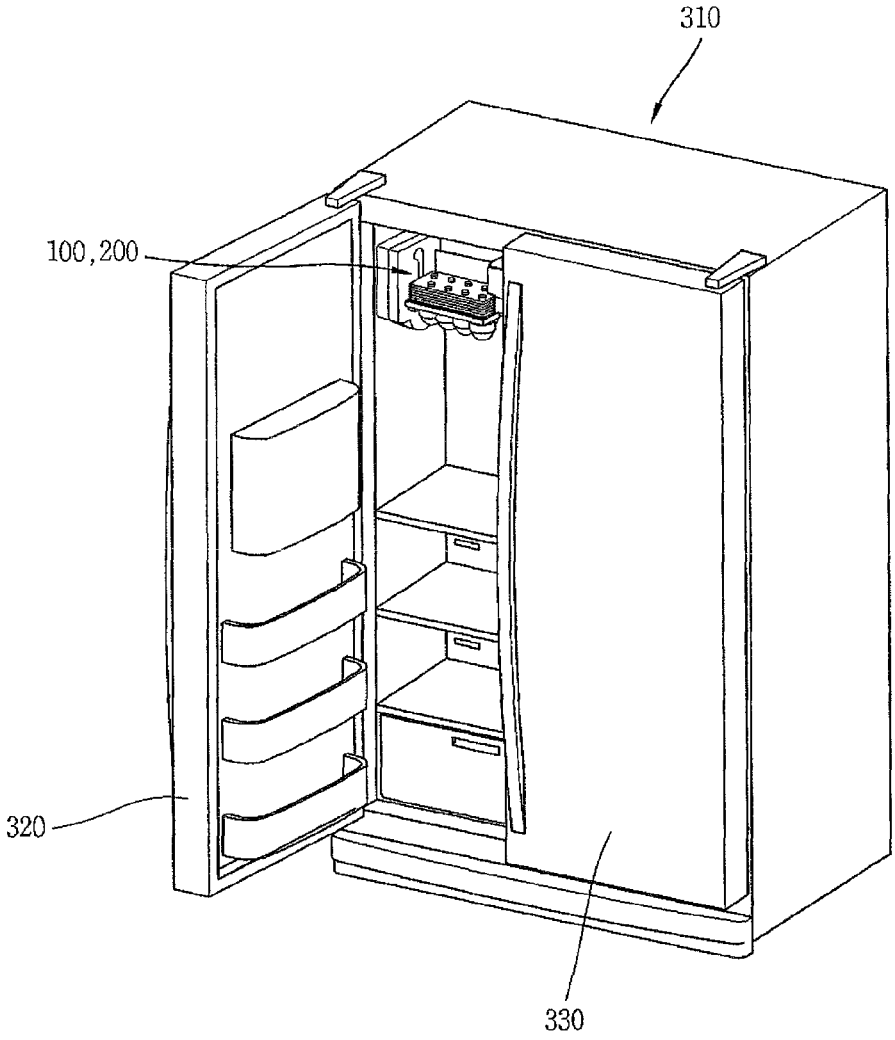
FIG. 11 is a perspective view showing how an ice maker is mounted in a refrigerator.

The ice makers 100, 200 can be applied to home refrigerators. For example, as shown in FIG. 11, a home refrigerator includes a refrigerator body 310 having a cooling chamber and a freezing chamber. A cooling chamber door 320 and a freezing chamber door 330 are mounted on the front of the cooling chamber and the freezing chamber, respectively. The ice makers 100, 200 are installed in the freezing chamber so that transparent ice pieces may be made as described above.

In the first embodiment of an ice maker and a refrigerator having the same as described above, the ice making container is maintained at the temperature higher than the freezing point, and ice core rods maintained at a temperature lower than the freezing point are inserted thereinto. Accordingly, even though ice is made starting at the periphery of the ice core rods, the water surface of the periphery of the ice making container is not frozen into ice, and bubbles generated when the ice is made may be rapidly discharged out, thereby allowing excellent transparent ice pieces without bubbles to be formed in the ice making container. Further, in the alternate embodiments, where the ice making container is maintained at a temperature lower than the freezing point, and where thawing rods maintained at a temperature higher than the freezing point are inserted thereinto, air bubbles may be rapidly discharged, and transparent ice pieces can be formed.

The ice maker can be used in home refrigerators or the ice maker could be also applied to water purifiers or other refrigerating machines in the same manner as aforementioned. Also, the ice maker can be installed with an ice taking-out apparatus or a dispenser, but can be also installed alone.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although a number of illustrative embodiments have been described, it should be understood that numerous other modifications and embodiments can be devised by those skilled in the art that will fall within the spirit and scope of the principles of this disclosure. More particularly, various variations and modifications are possible in the component parts and/or arrangements of the subject combinations which would fall within the scope of the disclosure, the drawings and the appended claims. In addition to variations and modifications in the component parts and/or arrangements, alternative uses will also be apparent to those skilled in the art.

What is claimed is:

1. An ice maker, comprising:

an ice making container provided with at least one ice making space to receive water therein;

at least one ice core, wherein a first portion of the at least one ice core at least partially extends into the at least one ice making space and a second portion of the at least one ice core includes a plurality of plate-shaped fins arranged in a stack so that a top surface of one fin is adjacent a bottom surface of another fin so that the second portion covers the at least one ice making space when in the ice making position, wherein the at least one ice core is maintained at a temperature lower than a freezing point of water for at least a portion of an ice making cycle conducted by the ice maker, and a mover coupled to the at least one ice core, wherein the mover moves the ice core relative to the at least one ice making space.

2. The ice maker of claim 1, wherein at least a portion of a peripheral surface of the ice making space is maintained at a temperature higher than the freezing point of water during at least a portion of an ice making cycle conducted by the ice maker.

3. The ice maker of claim 1, further comprising:

a heater coupled to the ice making container, the heater to heat an inner peripheral surface portion of the ice making container to a temperature higher than the freezing point of water.

4. The ice maker of claim 3, wherein the heater at least substantially conforms with a shape of at least a portion of an outer peripheral surface of the ice making container.

5. The ice maker of claim 4, wherein the portion of the outer peripheral surface surrounding the ice making space is used to create only one ice cube.

6. The ice maker of claim 5, wherein the heater is located adjacent a side wall of the ice making container that corresponds to the outer peripheral surface.

7. The ice maker of claim 5, wherein:

the heater contacts the outer peripheral surface to deliver heat in a direction toward the ice making space, and water adjacent the at least one ice core in the ice making space freezes before water adjacent an inner peripheral surface of the ice making container freezes, the water adjacent the inner peripheral surface freezing after the water adjacent the at least one ice core as a result of the heat from the heater.

8. The ice maker of claim 7, wherein the heater maintains the inner peripheral surface at a temperature above freezing and the water adjacent the at least one ice core maintained at a temperature below freezing by the at least one ice core.

9. The ice maker of claim 8, wherein bubbles in the water move through a pathway between the inner peripheral surface and ice formed around the ice core to form at least a substantially transparent ice cube.

10. The ice maker of claim 1, wherein the at least one ice core is formed of at least one of a metal capable of allowing water to freeze thereon or a non-metallic material.

11. The ice maker of claim 1, wherein the at least one ice core comprises:

a heat radiator; and at least one ice core rod coupled to the heat radiator, wherein a portion of the at least one ice core rod extends into the at least one ice making space.

12. The ice maker of claim 1, wherein the at least one ice core comprises or is coupled to a heater that heats a portion of the at least one ice core to a temperature higher than the freezing point of water.

13. The ice maker of claim 1, wherein the mover moves the at least one ice core upward and downward relative to the at least one ice making space of the ice making container.

14. The ice maker of claim 1, wherein the mover rotates the at least one ice core relative to the at least one ice making space.

15. A refrigerator comprising the ice maker of claim 1.

16. The ice maker of claim 1, wherein the at least one ice core comprises:

a heater that heats a portion of the at least one ice core to a temperature higher than the freezing point of water.

17. The ice maker of claim 1, wherein the at least one ice core is separated from an inner circumferential surface of the ice making container.

18. The ice maker of claim 17, wherein the at least one ice core comprises:

an at least one ice core body having a lateral surface coupled to a transfer unit, a plurality of ice core rods inserted into the ice core body in a substantially vertical direction, and a plurality of heat radiating fins laminated to each other and coupled to upper end portions of the ice core rods.

19. The ice maker of claim 18, wherein each of the ice core rods is arranged at an angle which crosses or is substantially perpendicular to a top surface of the water held in the at least one ice making space.

20. The ice maker of claim 1, wherein the mover is provided with one or more electric members arranged so as to move the ice core upwardly or downwardly, and to rotate the ice core at substantially a same time.

21. An ice maker comprising:

at least one ice core;

an ice making container provided with at least one ice making space to receive water therein, wherein a first portion of the at least one ice core at least partially extends into the at least one ice making space and a second portion of the at least one ice core includes a plurality of plate-shaped fins arranged in a stack so that a top surface of one fin is adjacent a bottom surface of another fin so that the second portion covers the at least one ice making space when in the ice making position, and wherein the at least one ice core is maintained at a temperature lower than a freezing point of water for at least a portion of an ice making cycle conducted by the ice maker; and a mover coupled to the at least one ice core, wherein the mover is provided with one or more electric members arranged so as to move the at least one ice core upwardly and downwardly, and to rotate the at least one ice core at substantially a same time.

22. The ice maker of claim 21, wherein the ice making container maintains at least a portion of a peripheral surface of the ice making space at a temperature higher than the freezing point of water during at least a portion of an ice making cycle conducted by the ice maker.

23. The ice maker of claim 21, wherein the ice making container further comprises a heater that heats an inner peripheral surface portion of the ice making container to a temperature higher than the freezing point of water.

24. The ice maker of claim 21, wherein the at least one ice core is formed of at least one of a metal having capable of allowing water to freeze thereon or a non-metallic material.

25. The ice maker of claim 21, wherein the at least one ice core comprises:

a heat radiator; and at least one ice core rod mounted on the heat radiator, wherein a portion of the at least one ice core rod extends into the at least one ice making space.

26. The ice maker of claim 1, wherein the at least one ice core includes an ice core rod which projects into the water a predetermined distance, the at least one ice core rod arranged at an angle which crosses or is substantially perpendicular to a top surface of the water held in the at least one ice making space.

27. An ice maker comprising:

an ice making container provided with at least one ice making space to receive water therein;

at least one ice core, wherein a portion of the at least one ice core at least partially extends into the at least one ice making space and a second portion of the at least one ice core includes a plurality of plate-shaped fins arranged in a stack so that a top surface of one fin is adjacent a bottom surface of another fin so that the second portion covers the at least one ice making space when in the ice making position, the at least one ice core being isolated from the inner circumferential surface of the ice making container, wherein the at least one ice core is connected to a heat radiator which has an area of surface larger than that of the at least one ice core, disposed at outside of the ice making space so as to maintained at a temperature lower than a freezing point of water for at least a portion of an ice making cycle conducted by the ice maker, and a mover coupled to the at least one ice core, wherein the mover moves the ice core upward and downward relative to the at least one ice making space of the ice making container.

28. The ice maker of claim 27, further comprising:

a heater coupled to the ice making container, the heater to heat an inner peripheral surface portion of the ice making container to a temperature higher than the freezing point of water.

29. The ice maker of claim 28, wherein the heater at least substantially conforms with a shape of at least a portion of an outer peripheral surface of the ice making container.

30. The ice maker of claim 29, wherein the portion of the outer peripheral surface surrounding the ice making space is used to create only one ice cube.

31. The ice maker of claim 30, wherein the heater is located adjacent a side wall of the ice making container that corresponds to the outer peripheral surface.

32. The ice maker of claim 27, wherein the at least one ice core is formed of at least one of a metal capable of allowing water to freeze thereon or a non-metallic material.

33. The ice maker of claim 27, wherein the ice core comprises or is coupled to a heater that heats a portion of the ice core to a temperature higher than the freezing point of water.

34. A refrigerator comprising the ice maker of claim 27.

35. The ice maker of claim 27, a mover coupled to the at least one ice core, wherein the mover is provided with one or more electric members arranged so as to move the ice core upwardly and downwardly, and to rotate the ice core at substantially a same time.

* * * * *